US006546774B2

(12) United States Patent
Granetzke

(10) Patent No.: US 6,546,774 B2
(45) Date of Patent: Apr. 15, 2003

(54) METHOD OF MAKING A LANCED AND OFFSET FIN

(75) Inventor: Dennis C. Granetzke, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/938,320

(22) Filed: Aug. 23, 2001

(65) Prior Publication Data

US 2003/0041640 A1 Mar. 6, 2003

(51) Int. Cl.[7] ..... B21D 53/04

(52) U.S. Cl. ..... 72/186; 72/187

(58) Field of Search ..... 29/890.049; 72/186, 72/187, 196

(56) References Cited

U.S. PATENT DOCUMENTS

| | | | | |
|---|---|---|---|---|
| 3,734,135 A | | 5/1973 | Mosier | |
| 4,170,122 A | | 10/1979 | Cowell | |
| 4,510,786 A | | 4/1985 | Strangward | |
| 6,032,503 A | * | 3/2000 | Grippe | 72/186 |

FOREIGN PATENT DOCUMENTS

| | | |
|---|---|---|
| EP | 1065466 | 1/2001 |

* cited by examiner

*Primary Examiner*—Lowell A. Larson
(74) *Attorney, Agent, or Firm*—Wood, Phillips, Katz, Clark & Mortimer

(57) ABSTRACT

Slow production speeds in the manufacture of lanced and offset fins for use in heat exchanger tubes are eliminated through the use of a method of forming the fins involving a plurality of roll assemblies located along a forming path which may operate on a strip of fin forming material of indeterminate length. After being formed, the fin may be cut to any desired length.

22 Claims, 8 Drawing Sheets

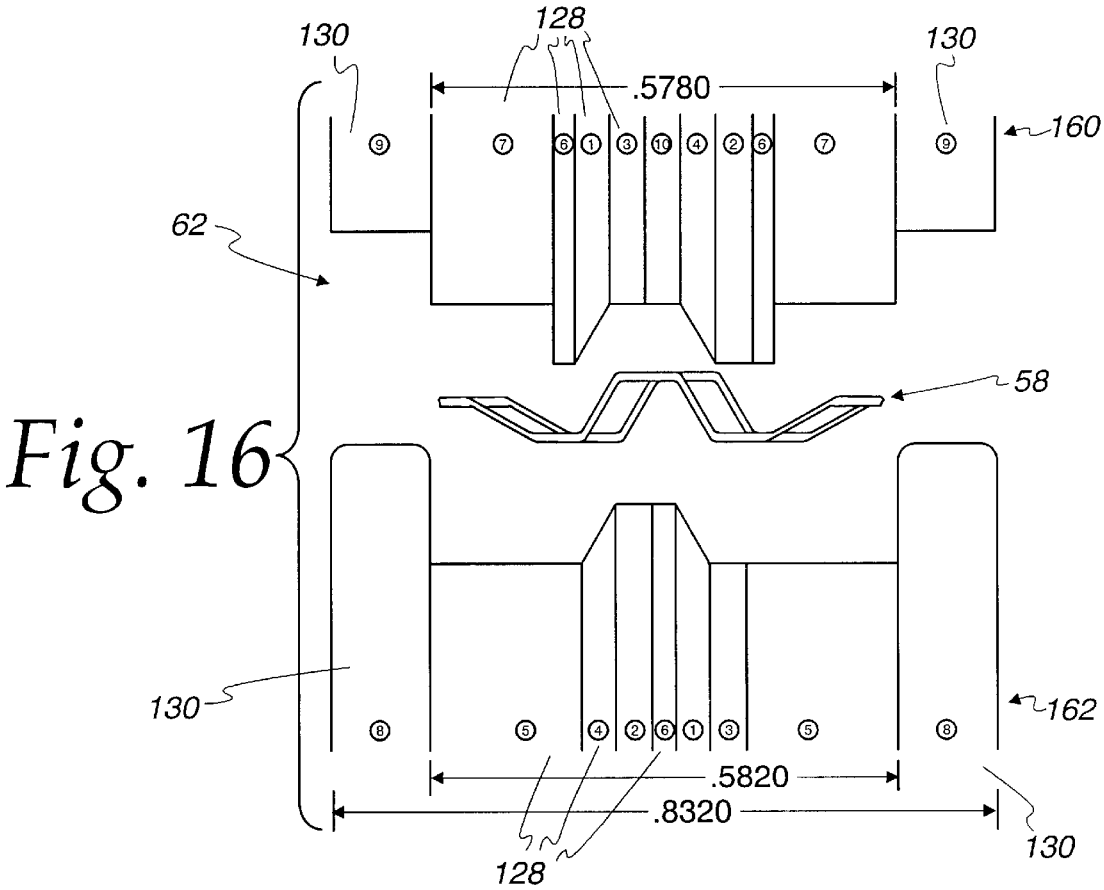
Fig. 16
Fig. 17
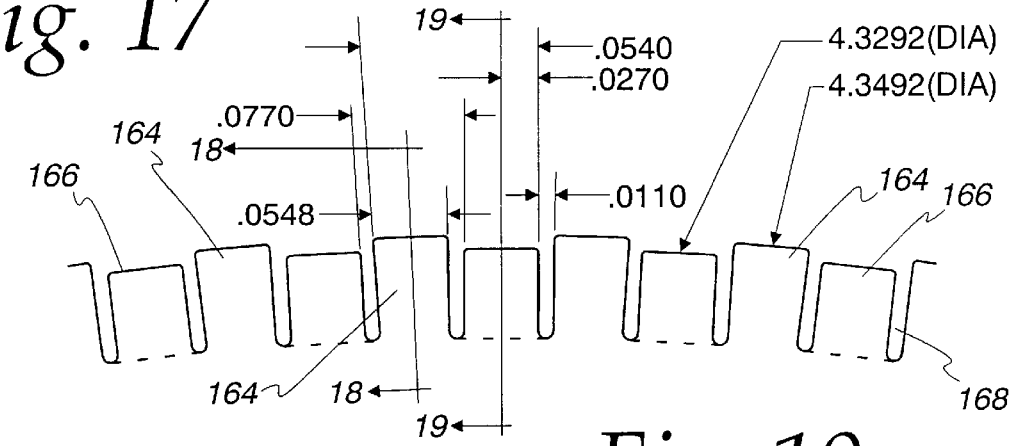
Fig. 18
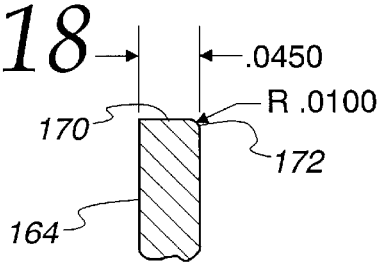
Fig. 19
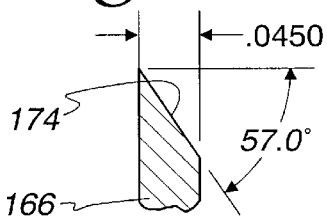

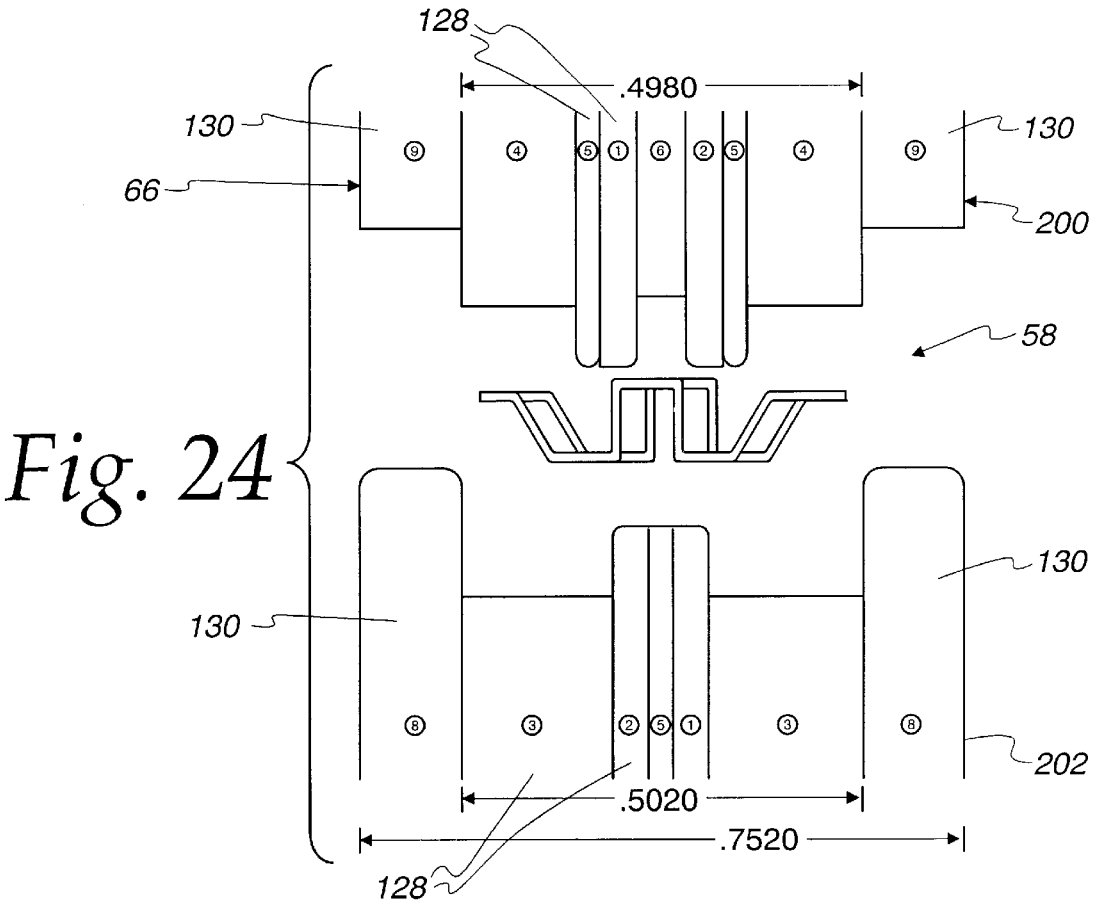
Fig. 24
Fig. 25
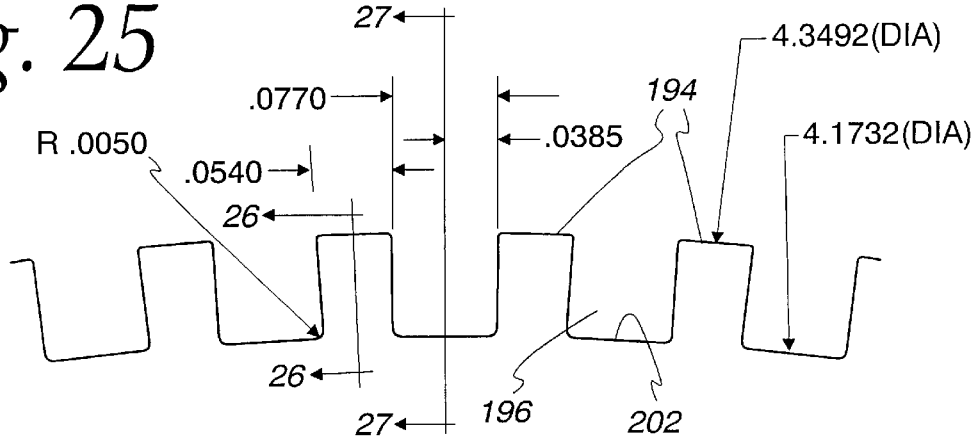
Fig. 26
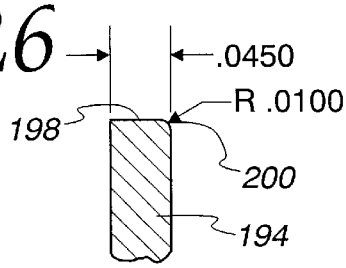
Fig. 27
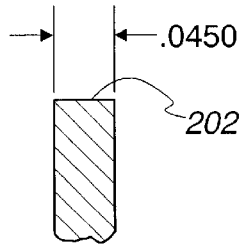

METHOD OF MAKING A LANCED AND OFFSET FIN

FIELD OF THE INVENTION

This invention relates to heat exchangers, and more particularly, to a lanced and offset fin of the type used within a fluid flow path within a heat exchanger.

BACKGROUND OF THE INVENTION

Many heat exchangers in use today employ one or more rows of so-called flattened tubes which extend between headers provided with tanks or even tubular headers. External fins are bonded to the exterior of the flattened tubes and in some instances, internal fins within the tubes are utilized. Such fins increase surface area within the tubes and provide a means whereby heat may flow from the fluid flowing within the tubes to the insert and then to the walls of the tube through the insert. Thus, where the insert is a better conductor of heat than the fluid flowing within the tube, enhanced heat transfer results.

In addition, such inserts may provide a turbulating function. That is to say, they increase turbulence in the fluid flowing within the tube which in turn is known to increase heat transfer efficiency.

Moreover, where such tubes are to carry fluid at a relatively high pressure and are not supported by the external fins, the inserts, being bonded to both side walls, strengthen the tubes as well.

While inserts of the sort generally alluded to previously have taken on many forms, a so-called "lanced and offset" fin is preferred in many applications. The heat exchanger art is beginning to recognize that lanced and offset fins are "the" internal fin for use in flattened tubes because of their ability to perform all of the above functions with at least the same efficacy, and in many instances greater efficacy, than more standard internal fin configurations. Notwithstanding, there has not been universal adoption of lanced and offset fins for such applications.

In particular, heretofore, lanced and offset fins have been produced by what the art refers to as stitching machines. In the operation of such machines, the dies that produce the lanced and offset configuration of the fin move forward and back and from side to side. The fin formed has a flow path that extends in the direction across the stitching machine. Thus, the length of the fin is limited to the maximum operative width of the stitching machine. As a consequence, and dependent upon the length of the flattened tubes that are to be provided with such lanced and offset fins, it may be necessary to insert the lanced and offset fin as more than one piece in order to extend for the full length of the flattened tube. Unfortunately, this takes plural insertion operations which are time consuming and when more than one fin piece is inserted into a tube, there is a possibility that there will be a gap between the insert pieces. At such a location, there will be no insert to bond to the interior sides of the tube and as a consequence, there will be a location that is not provided with enhanced strength by the presence of an insert bonded thereto. Consequently, the possibility of failure when subject to high pressure is enhanced.

Furthermore, the very nature of the stitching machine operation is such that it is a very, very slow production method. Typically, for a length equal to the maximum operative length of the stitching machine, the stitching machine can only produce one leg of a lanced and offset fin during each second of operation. Thus, a fin having six legs would require six seconds to manufacture.

Furthermore, stitched inserts have a tendency to nest in one another, making them difficult to separate during production. The fins may be damaged during the separation process and require scrapping for this reason. Alternatively, if they cannot be readily separated, an assembly of two or more nested fins may require scrapping because they cannot be separated.

The present invention is directed to overcoming one or more of the above problems.

SUMMARY OF THE INVENTION

It is the principal object of the invention to provide a new and improved method for making a lanced and offset fin. More specifically, it is an object of the invention to provide a method of making such a fin in a continuous fashion without the need for the use of stitching machines. In a preferred embodiment, the invention contemplates a method of making a lanced and offset fin with roll forming equipment.

An exemplary embodiment of the invention contemplates a method of making a lanced and offset heat transfer fin having "n" legs and which includes the steps of: a) advancing an elongated, generally planar strip of fin forming material in its direction of elongation along a fin forming path; b) forming "n" rows of transfer slits in the strip with crowns extending between adjacent slits in each row at locations intermediate the ends of the slits with adjacent crowns in each row being oppositely directed; and c) thereafter bending the strip through a substantial acute angle at each crown and at the ends of adjacent slits in each of the rows with the ends at which the bending occurs alternating from one side of the row to the other for adjacent slits.

In a preferred embodiment, the substantial acute angle is about 90°.

Most preferably, step c) of the method is performed in at least two sequential operations. According to this embodiment, a first of the sequential operations includes bending to an acute angle substantially less than the substantial acute angle and thereafter bending to the substantial acute angle.

One embodiment of the invention contemplates that "n" is an even integer of four or more and one of the operations includes first bending at a first selected two of the rows and the other of the operation includes thereafter bending at a selected different two of the rows.

In a highly preferred embodiment, the first selected two of the rows are the two centrally located rows.

One embodiment of the invention contemplates that step c) is followed by the step of sizing the legs.

In a highly preferred embodiment, steps b) and c) are performed by using at least one roll in each of the steps to form the crowns and transverse slits and to thereafter bend the strips.

Other objects and advantages will become apparent from the following specification taken in connection with the accompanying drawings.

DESCRIPTION OF THE DRAWINGS

FIG. 16 is a view similar to FIG. 9 but illustrating the configuration of a roll assembly employed to produce the fin shape illustrated in FIG. 5;

FIG. 17 is a fragmentary elevation of a bending profile of a cutting disk employed in the roll assemblies shown in FIGS. 16 and 23;

FIG. 18 is an enlarged, fragmentary, sectional view taken along the line 18—18 in FIG. 17;

FIG. 19 is an enlarged, fragmentary, sectional view taken approximately along the line 19—19 in FIG. 17;

FIG. 24 is a view similar to FIG. 9 but employed to produce the fin strip configuration illustrated in FIG. 7;

FIG. 25 is an enlarged, fragmentary view of a cutting profile employed in the roll assemblies of FIG. 24 and FIG. 28.

FIG. 26 is an enlarged, fragmentary, sectional view taken approximately along the line 26—26 in FIG. 25;

FIG. 27 is an enlarged, fragmentary, sectional view taken approximately along the line 27—27 in FIG. 25;

Figure 1:
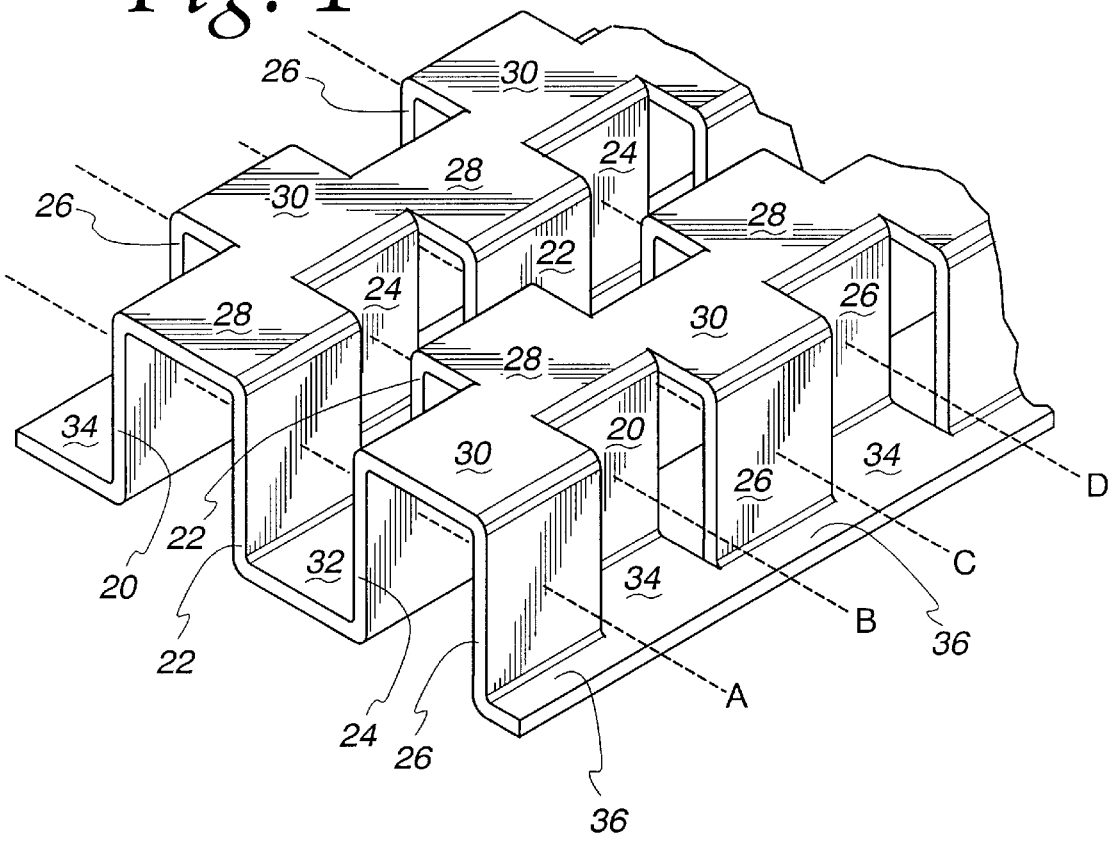
FIG. 1 is a fragmentary, perspective view of a lanced and offset fin made by one embodiment of the method of the invention.

It is to be particularly noted that FIGS. 9–29 are scaled drawings and that the components illustrated have the dimensions shown in the drawings.

DESCRIPTION OF THE PREFERRED EMBODIMENT

The method of the invention for making a lanced and offset fin is ideally suited for producing lanced and offset fins formed of aluminum. However, it is to be understood that the invention can also be utilized with efficacy in the manufacture of brass, copper or steel fins as well. In many cases, the material being used, as, for example, aluminum, is suited for the brazing of the components of a heat exchanger into assembled relation and when employed in a heat exchanger that is to be brazed, it will be typical to provide braze clad material on both sides of a strip of which the fin is to be formed. However, no limitation to particular materials or particular assembly methods such as brazing are intended insofar as expressly stated in the appended claims.

Referring now to FIG. 1, a four legged lanced and offset fin is illustrated. A first leg is shown at 20 while a second leg is shown at 22. A third leg is shown at 24 while a fourth is shown at 26. The legs 20 and 22 are connected at their upper ends by a peak or crest 28. A similar crest or peak 30 connects the upper ends of the legs 24, 26. The lower ends of the legs 22, 24 are connected by a lower crest or peak 32. A partial crest or peak 34 extends from the lower end of the leg 20 in a direction away from the leg 22 while a smaller partial crest or peak 36 extends from the lower end of the leg 26 away from the leg 24. These components form a first row A of legs and crests that generally extends transversely of the direction of elongation of the fin which is from lower left to upper right as illustrated in FIG. 1. A second row B of legs and crests is immediately behind and connected to the row A in a fashion well known. The row B is a reversal of the row A which is to say that the leg 26 appears on the left as viewed in FIG. 1 while the leg 20 appears on the right as viewed in FIG. 1.

A third row C is identical to the row A while the next row D is identical to the row B. These rows alternate from one end of the strip to the other in the above-described fashion.

It will be noted that the arrangement is such that the leg 20 of the row A is located midway between the legs 24, 26 of the row B; the leg 22 of the row A is located midway between the legs 22, 24 of the row B; the leg 24 of the row A is located midway between the legs 22, 20 of the row B and the leg 26 of the row A is located to one side of the leg 20 of row B a distance approximately equal to half the distance between any two adjacent legs in a given row. The resulting configuration is that shown in FIG. 2. In the same fashion, the crests 28, 30 are staggered, between adjacent rows A, B, C, D, etc., although they are connected over approximately half their length to the adjacent crests as can be seen in FIG. 1.

Figure 2:
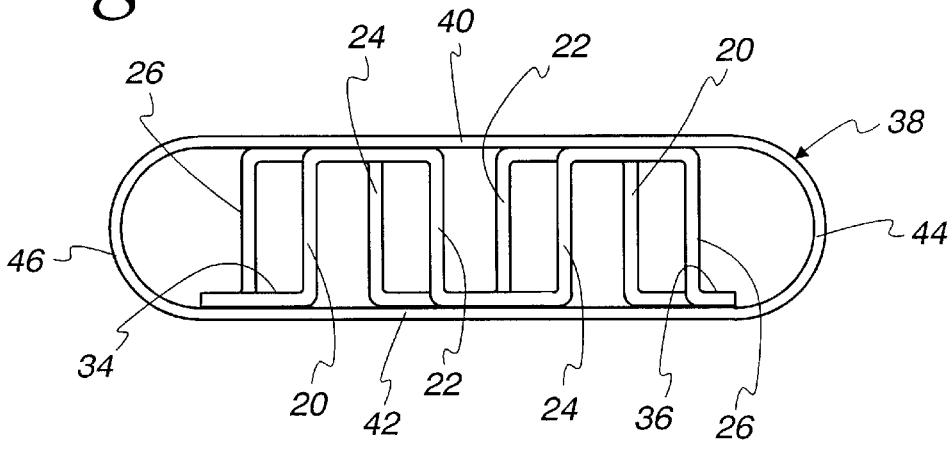
FIG. 2 is a sectional view illustrating a lanced and offset fin fitted within and bonded to a flattened tube for use in a heat exchanger.

FIG. 2 also shows the lanced and offset fin inserted in a so-called flattened tube, generally designated 38, of the type that are commonly used in heat exchangers. The tube 38 has opposed flat walls 40, 42, that are connected by rounded walls 44, 46 at their ends. In the usual case, the crests 28, 30 will be bonded to the interior of the walls 40,42 as by soldering or by brazing. As is known in the art, the resulting structure provides a tube 38. The tube 38 is highly desirable in many types of heat exchangers. Because the lanced and offset fin is metallurgically bonded to the tube 38, heat from a fluid flowing within the tube 38 is easily transferred to or from the side walls 40, 42 via the legs 20, 22, 24, 26 which provide additional surface area within the interior of the tube 38. Consequently, heat transfer is enhanced whenever the thermal conductivity of the lanced and offset fin greater than that of the heat exchange fluid passing through the tube 38.

The legs 20, 22, 24, 26 and inside edges of the crest 28, 30, also break up a boundary layer condition in fluid flow in their vicinities and/or induce turbulence. As is well known, increased turbulence or lessening of boundary layer effects in heat transfer fluids also improves heat transfer; and the lanced and offset fin is functional in this effect as well.

Finally, where the heat exchange fluid is passed through the tube 38 at relatively high pressures that would tend to expand the tube 38 from its flattened tube shape to a more rounded shape, the legs 20, 22, 24, 26 act as strengthening webs which serve to maintain the side walls, 40, 42 in a configuration illustrated in FIG. 2.

Figure 3:
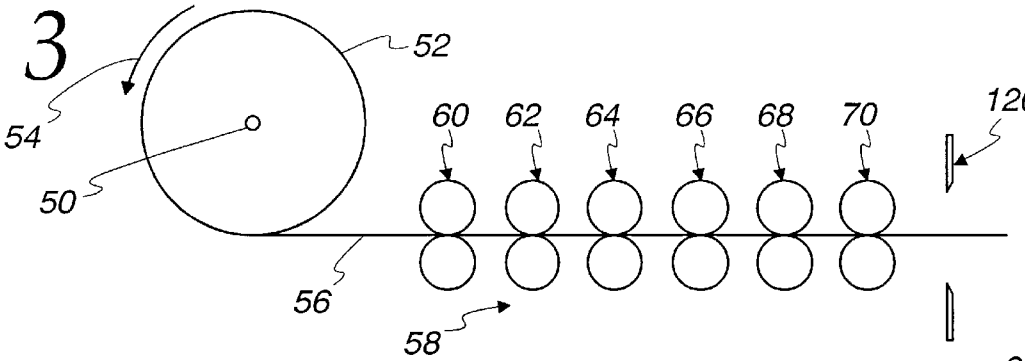
FIG. 3 is a somewhat schematic illustration of an apparatus that may be used to perform the method.

FIG. 3 somewhat schematically illustrates a roll forming machine which may be used to practice the method of the present invention. The apparatus of FIG. 3 is illustrated as exemplary and those skilled in the art will appreciate that other types of forming equipment could be used if desired.

As illustrated in FIG. 3, a spindle 50 mounts a roll of fin forming strip material 52 for rotation about the spindle 50 in a direction illustrated by an arrow 54. The row of fin material 52 is of indeterminate length which is to say that the row can have any desired length and its selection will depend upon the objects of manufacture. The fin material 52 comes off of the roll as a thin, generally planar strip 56 and typically will have a thickness of a few thousandths of an inch upward, depending upon the strength and heat carrying characteristics desired of the legs 20, 22, 24, 26. The strip 56 is fed along a forming path, generally designated 58, which includes a series of roll forming assemblies. In the exemplary embodiment, six such assemblies are utilized and are generally numbered 60, 62, 64, 66, 68, and 70. In a preferred embodiment, where a four legged lanced and offset fin such as shown in FIG. 1 is to be formed, there will be six of the assemblies 60–70. However, the number of assemblies will be increased for reasons that will become apparent hereinafter as the number of legs in the fin being manufactured is increased.

Figure 4:
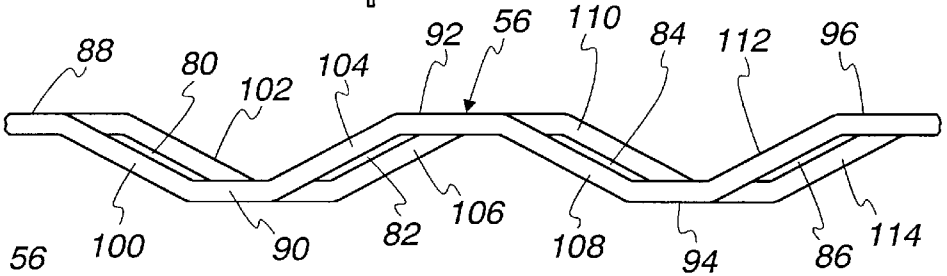
FIGS. 4–8 inclusive, are end views of a strip of fin forming material as it appears following the performance of various steps in one embodiment of the method.

In the preferred embodiment, which again, is a four legged fin, the roll assembly 60 performs a slitting operation on the strip 56 wherein four rows of aligned slits are formed in the strip 56. The rows of slits are not to be confused with the rows of legs and crests identified as A, B, C and D in FIG. 1. Rather, the rows of slits extend longitudinally of the strip 56 and the slits in each row have the same spacing longitudinally of the strip as well as the same spacing between adjacent slits and adjacent rows. In addition, the roll assembly forms crowns in the parts of the strip between adjacent slits in each row with alternating parts in a row having crowns extending in one direction and the remaining parts having crowns extending in the opposite direction. The result is the configuration illustrated in FIG. 4 wherein slits 80, 82, 84 and 86 from one side of the strip 56 are evident. At the same time, the roll assembly 60 forms crowns 88, 90, 92, 94 and 96 in each of the rows of legs and crests A, B, C, D, etc. (FIG. 1). These crowns 88, 90, 92, 94, 96 eventually become the crests 28, 30 or the connecting part 32, where the partial crests 34, 36 as the case may be in the finally formed fin. The original plane of the fin material 56 is shown at P in FIG. 4. It will be observed that extending between the crowns are strip parts 100, 102, 104, 106, 108, 110, 112 and 114 which ultimately define the legs 20, 22, 24, 26. As illustrated in FIG. 4, these parts 100–114 are at a minor acute angle to the plane P which is to say that they are at an acute angle less than 45°, and preferably in the range of 15–45°, and even more optimally, at 30°, to the plane P.

Figure 5:
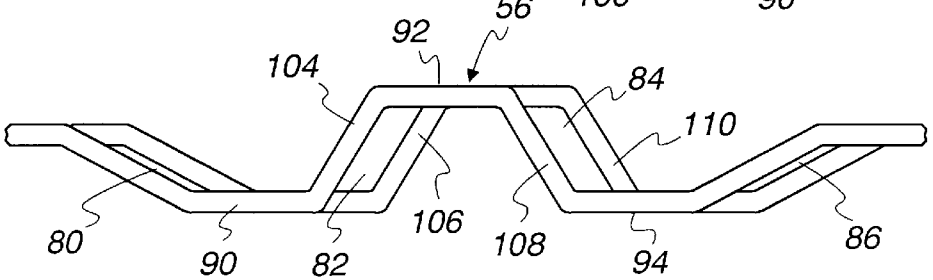

After exiting the roll assembly 60 and proceeding along the forming path 58 to the roll assembly 62, the fin material 56 is formed into the configuration illustrated in FIG. 5. The roll assembly 62 acts against the parts 104, 106, 108, 110 that extend between the crests 90, 92 and 94 to preform them to a major acute angle which is to say, an acute angle to the plane P that is more than 45° and less than 90°, and most preferably in the range of 46–75°, and even more preferably, an acute angle of approximately 57–60°.

It is to be observed that this forming takes place in the area of the two innermost or central rows of slits 82, 84 leaving the strip 56 untouched in the vicinity of the outermost rows of slits 80, 86. This operation may be referred to as a preforming operation wherein the parts 104, 106, 108, 110 are preformed toward their final shape but not fully bent to that condition.

Figure 6:
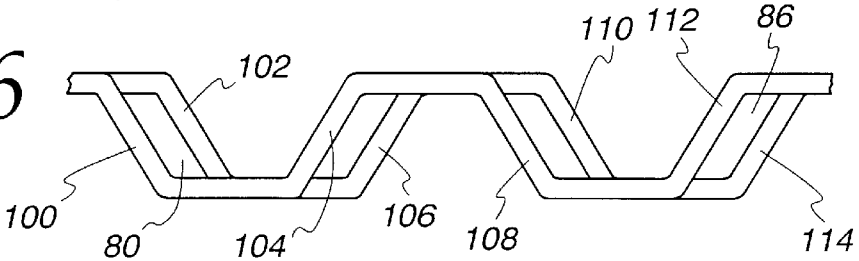

After exiting the roll assembly 62, the strip, now in the configuration illustrated in FIG. 5 is passed through the roll assembly 64 where it emerges in the configuration illustrated in FIG. 6. In the roll assembly 64, the strip parts 100, 102, 112 and 114 which encompass the slits 80 and 86 and their respective rows are bent to a major acute angle as previously defined. At this time, the strip parts 104, 106,108, 110 are untouched and not changed from the configuration in which they emerge from the roll assembly 62. The fin strip 56 then moves to the roll assembly 66 in the configuration illustrated in FIG. 6 and emerges from the roll assembly 66 in the configuration illustrated in FIG. 7. In the roll assembly 66, the fin parts 104, 106, 108, 110 are finally formed to a position that is generally transverse to the plane P. In the roll assembly 66, the fin parts 100, 102, 112 and 114 are not altered but are left in the same form as illustrated in FIG. 6.

After emerging from the roll assembly 66, the fin strip enters the roll assembly 68 whereat the fin parts 100, 102, 112 and 114 are now bent to be transverse to the plane P. At this time, the fin parts 104, 106, 108 and 110 are not further acted upon. As a result, a configuration approximating the final configuration illustrated in FIG. 1 results.

Figure 8:
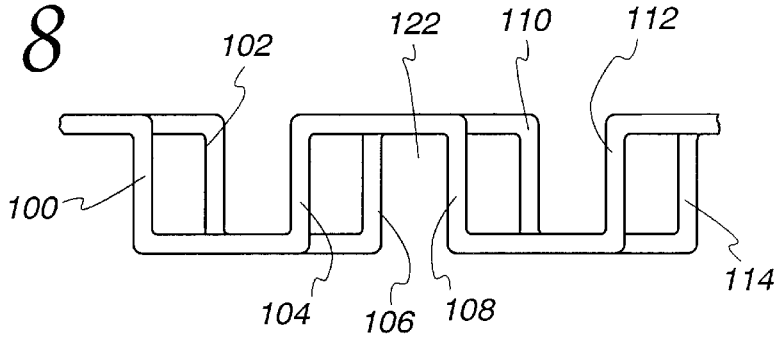

After emerging the roll assembly 68, the fin strip, in the configuration illustrated in FIG. 8, is moved to a roll assembly 70 where the same is sized in a manner to be seen. The sizing operation basically results in a configuration such as illustrated in FIG. 8 but assures that all horizontally extending elements that originally were defined by the crowns 88, 90, 92, 94, 96 are in appropriate parallel planes so as to assure good contact when the fin is inserted into a tube such as the tube 38 to allow brazing and/or other metallurgical bonding to occur without flaws. In some cases where good adherence to tolerances is not required, the roll assembly 70 may be eliminated.

After the sizing operation that occurs in the roll assembly 70, the strip is advanced to a cutter assembly, generally designated 120 whereat the strip may be cut to desired lengths for subsequent insertion into a tube 38.

Certain features of the method as above described are to be noted. Firstly, the forming of the strip parts 100, 102, 104, 106, 108, 110, 112, 114 is such that no roll assembly 60, 62, 64, 66, or 68 operates to bend more than two of the strip parts in any given one of the rows of legs A, B, C, D (FIG. 1). It is also to be observed that the bending process of such parts is initiated at the two central or innermost parts in the strip and then moves outwardly therefrom to the next two innermost parts, one on each side of the center, and continues that progression, acting on no more than two parts in any one of the rows A, B, C, D at any given time. This eliminates thinning of the metal as well as simplifies the design of the roll assemblies. It should also be noted that the same general sort of apparatus may be employed in making lanced and offset strips having more than four legs. It is only necessary to add two roll assemblies for each additional two legs to the apparatus and in the proper sequence as described immediately preceding.

Generally speaking, preforming operations which, as described above, occur in the roll assemblies 62 and 64 are performed before the final forming that occurs at roll assemblies 66 and 68. However, in many instances, it may be desirable to preform the parts at two rows of slits and then finally form the parts at those same two rows of slits before moving on to preform the parts at a different pair of slit rows. Specifically, it may be desirable to finally form the central or innermost strip parts 104, 106, 108, 110 to the configuration of those parts illustrated in FIG. 7 before performing any preforming operations on the parts 100, 102, 112, 114. In this way, an unobstructed, central channel or space 122 (FIG. 7) will be formed early in the forming process and the same may be used in connection with a flat disk or the like in the center of the roll assemblies to act as a guide for the strip through subsequent roll assemblies, thereby improving the manufacturing tolerances.

Figure 9:
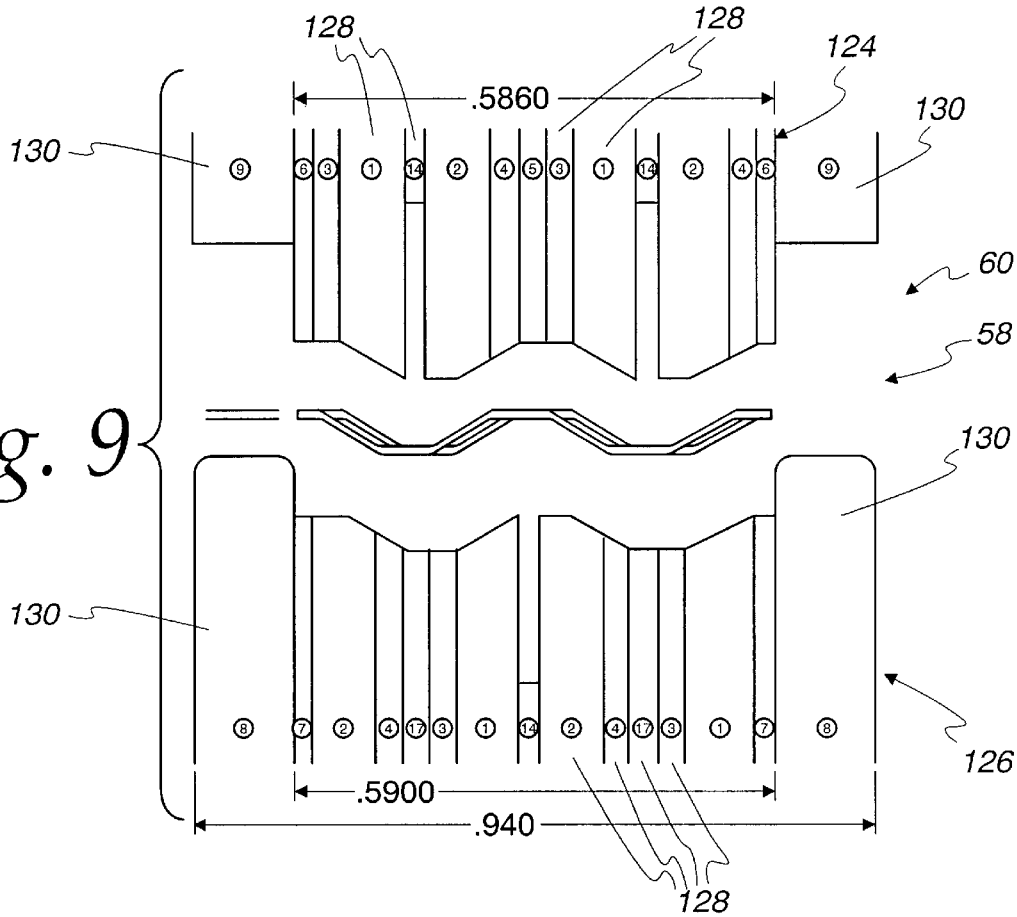
FIG. 9 is a fragmentary, exploded, sectional view of one roll assembly employed in the apparatus of FIG. 3 to form a strip of fin forming material to the configuration illustrated in FIG. 4.
Figure 10:
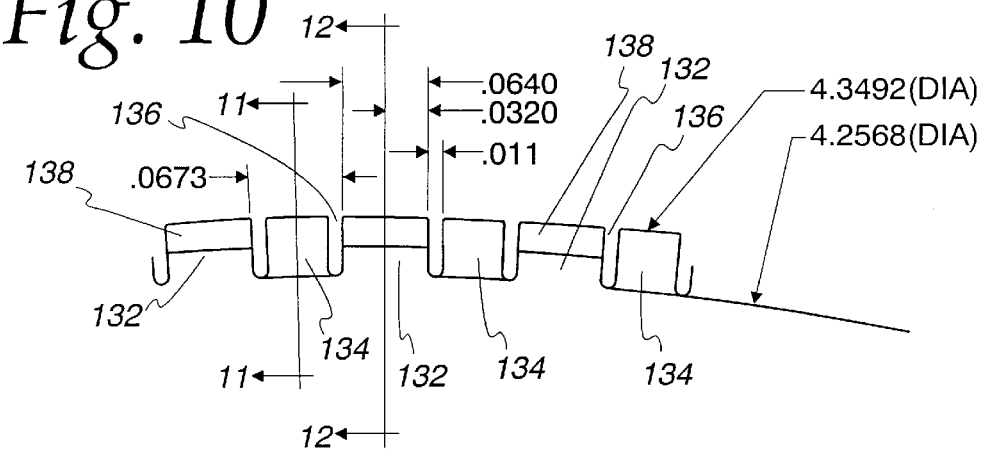
FIG. 10 is an enlarged, fragmentary, side elevation showing a cutting profile disk used in the assembly of FIG. 9.
Figure 11:
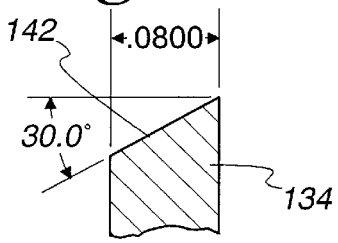
FIG. 11 is a sectional view taken approximately along the line 11—11 in FIG. 10.
Figure 12:
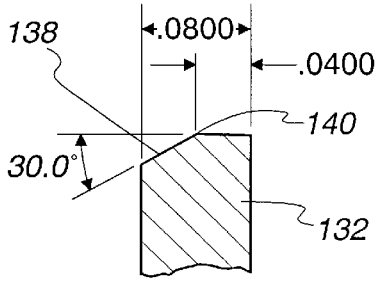
FIG. 12 is a sectional view taken approximately along the line 12—12 in FIG. 10.

Turning now to FIGS. 9–15, the construction of the roll assembly 60 will be described. The roll assembly 60 includes an upper roll, generally designated 124 and a lower roll, generally designated 126. Each of the rolls 124 and 126 are made up of a plurality of discs 128 which are stacked against one another and sandwiched between end discs 130. The rolls 124 and 126 are rotatable about respective, parallel axes (not shown) and are inner fitted to define a first part of the forming path 58. As can be seen in FIG. 9, the various discs are given reference numbers in circles. The discs labeled "1", "2", "3" and "4" are profile discs which is to say that they have toothed peripheral surfaces while the remainder of the discs are generally cylindrical and have dimensions indicated in Tables 1 an 2 set forth hereinafter. Discs "1" and "2" are identical to one another as are discs "3" and "4" except that they are staggered on the rotational axis by an angular distance equal to the distance between the center lines of two adjacent teeth. As can be appreciated from FIG. 9, disc "1" faces disc "2" in four locations along the axis. FIGS. 10–12 indicate the construction of discs "1" and "2" as well as certain of the dimensions thereof. Discs "1" and "2" include peripheral, radially outwardly extending teeth 132 and 134 alternating with one another and separated by gaps 136 having the dimensions illustrated. As can be seen in FIGS. 11 and 12, the teeth 132 have their radially outer surface provided with a partial bevel 138 which extends from a point 140 midway between the two sides of the disc and which is at an angle of 30°. The discs 134 have a 30° bevel 142 which extends from one side of the disc to the other and the same are located in their respective rolls 124, 126 so that teeth 132 on the roll 124 extend between the teeth 134 on the roll 126, and vice-versa.

Figure 13:
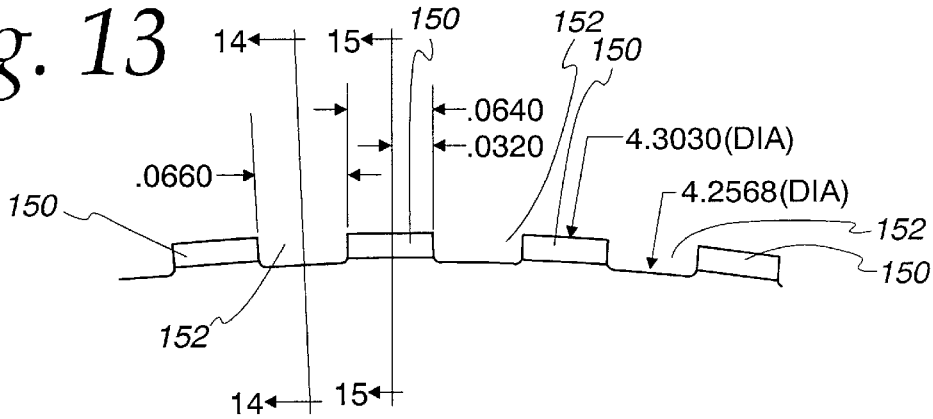
FIG. 13 is a view similar to FIG. 10 but showing a different cutting profile employed in the assembly of FIG. 9.
Figure 14:
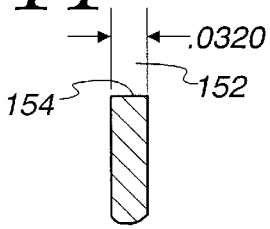
FIG. 14 is an enlarged, fragmentary sectional view taken approximately along the line 14—14 in FIG. 13.
Figure 15:
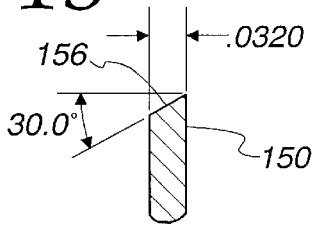
FIG. 15 is an enlarged, fragmentary sectional view taken approximately along the line 15—15 in FIG. 13.

FIGS. 13–15 indicate the profile of discs "3" and "4". It will be appreciated that disc "3" is intended to be abutted against the corresponding disc "1" while disc "4" is intended to be abutted against the corresponding disc "2". The discs "3" and "4" include a series of teeth 150 spaced by slots 152 which have a significantly greater angular extent than the slots 136 in discs "1" and "2". Specifically, the slots 152 have the dimensions illustrated in FIG. 13. The slots 152 have a bottom surface 154 which is part of a cylinder having the diameter illustrated in FIG. 13. The teeth 150 have a 30° beveled outer surface 156. In practice, the disc "3" is abutted against a disc "1", and a disc "4" abutted against the disc "2" such that the bevel 156 forms a continuation of the bevel 138 on the teeth 132.

Upon a consideration of the foregoing description, it will be appreciated that the bevel 142 for a given tooth on the upper roll 124 will mesh with the bevel formed by the bevels 138, 156 on the lower roll 126 and vice-versa so as to form the stagger between the parts 100, 102, 104, 106, 108, 110, 112, 114 as illustrated in FIG. 4.

Turning now to FIGS. 16–22, the roll assembly 62 will be described. Referring specifically to FIG. 16, the same includes an upper roll 160 and a lower roll 162 which define the forming path 58 in the vicinity of the roll assembly 62. Again, each roll 160, 162 is made up of a stack of discs 128 stacked between end discs 130 and rotatable about parallel axes. Discs "1" and "2" are identical to one another except for the same sort of offset mentioned previously, as are discs "3" and "4". The remaining discs are all cylindrical and have the construction illustrated in the following tables.

FIG. 17 illustrates the construction of discs "1" and "2" and the same is seen to include radially extending, peripheral teeth including long teeth 164 and short teeth 166 separated by a gap 168. The short teeth 166 are illustrated in FIG. 18 and have a cylindrical exterior 170 with a small radius 172 on one side thereof. The long teeth 166 have a beveled exterior surface 174 extending from one side of the tooth to the other. The bevel is on the order of 60° and is shown in FIG. 19 as 57°. It should be observed that the disc illustrated in FIGS. 17–19, not only serve as discs "1" and "2" in the roll assembly 62 but also serve as the same numbered discs in the roll assembly 64 and will not be described further in connection therewith.

Figure 21:
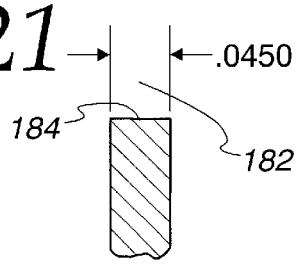
FIG. 21 is an enlarged, fragmentary view taken along the line 21—21 in FIG. 20.
Figure 22:
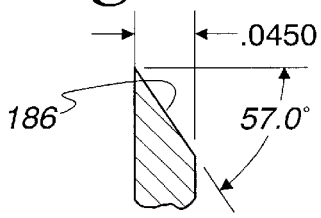
FIG. 22 is an enlarged, fragmentary sectional view taken approximately along the line 22—22 in FIG. 20.

Discs "3" and "4" in both the roll assembly 62 and the roll assembly 64 have a profile that includes radially outwardly extending teeth 180 separated by large gaps 182. The bottom surface 184 of each gap is cylindrical as illustrated in FIG. 21 while each of the teeth 180 have a beveled exterior surface 186 which is beveled at an angle on the order of 60° and shown as 57° in FIG. 22.

Figure 20:
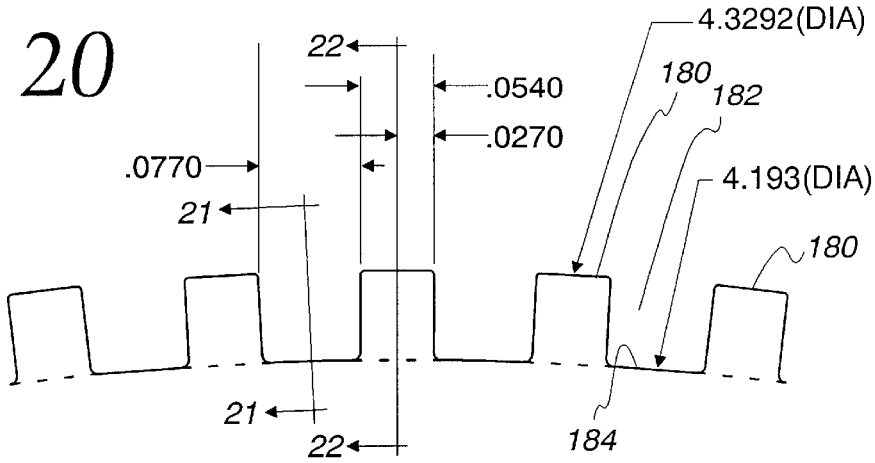
FIG. 20 is a fragmentary, enlarged view of a cutting profile employed in the roll assemblies of FIG. 16 and FIG. 23.

The discs shown in FIGS. 17 and 20 are arranged such that a number 1 disc has its long teeth 164 extending into the gap 182 of a No. 4 disc while a No. 2 disc has its long teeth 164 extending into the slots 182 of a No. 3 disc. This arrangement provides for the configuration of the parts 104, 106, 108, 110 as illustrated in FIG. 5.

Figure 23:
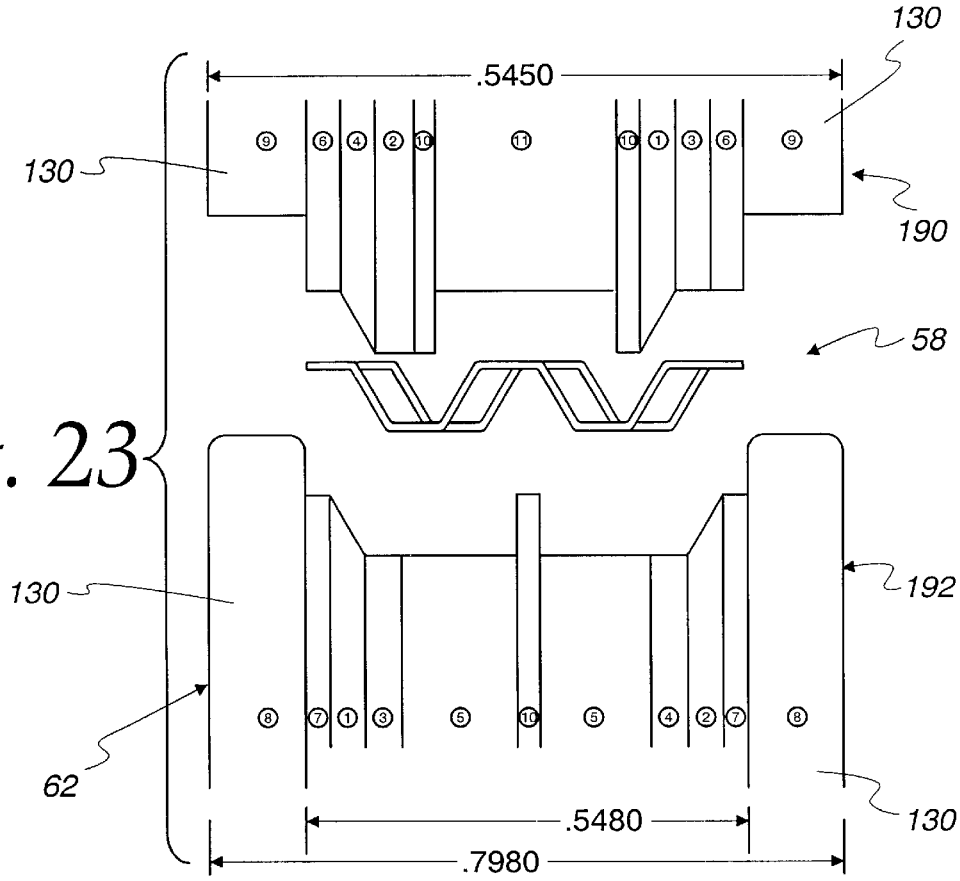
FIG. 23 is a view similar to FIG. 9 but of still another roll assembly employed to produce the fin strip configuration illustrated in FIG. 6.

The roll assembly 64 (FIG. 3) is shown in FIG. 23 and includes an upper roll, generally designated 190, and a lower roll, generally designated 192 which define the forming path 58 in the vicinity of the roll assembly 64. The discs shown at "1", "2", "3" and "4" in the roll assembly 62 are those shown in FIGS. 17–22 and described previously. All other numbered discs are generally cylindrical and have the dimensions shown in the following Tables. The roll assembly 62 acts to form the strip parts 100, 102, 112, 114 to the configuration illustrated in FIG. 6.

FIG. 24 illustrates the roll assembly 66 which, as with the previously roll assemblies as described, includes a stack of discs. Of the discs shown in FIG. 24, only the No. 1 and No. 2 discs are profiled, the remainder being generally cylindrical with the dimensions shown in the following Table. In some cases, as with the No. 5 discs, the corners may have a small radius as shown.

Figure 7:
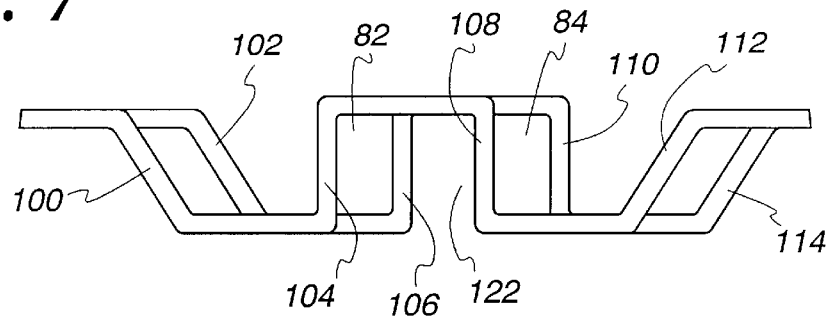

Referring to FIGS. 25–27, the No. 1 and No. 2 discs again are identical and are located in the stack in the staggered relation mentioned previously. The periphery of these discs includes radially outwardly extending teeth 194 separated by slots 196. FIG. 26 illustrates the cross-section of a typical tooth 194 which has a cylindrical outer surface 198 with a small radius 200 at one side thereof. The bottoms 202 of the slots 196 are cylindrical as shown in FIG. 27. The teeth 194 on disc No. 1 enter the slots 196 on disc No. 2 and vice-versa. The roll assembly shown in FIGS. 24–27 operates on the strip to produce the configuration illustrated in FIG. 7 which is to say, they act on the strip parts 104, 106, 108, 110 as illustrated in FIG. 7. And, as in the case with the previously described roll assemblies, the roll assembly 66 includes an upper roll, generally designated 200 and a lower roll, generally designated 202.

Figure 28:
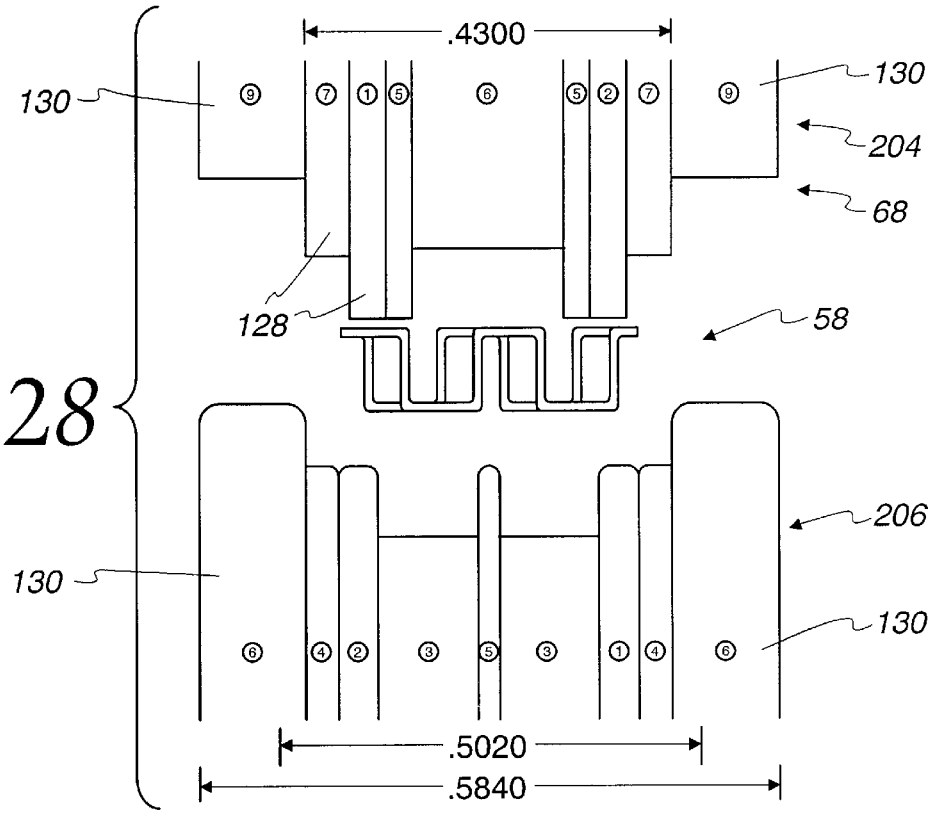
FIG. 28 is a fragmentary, sectional view of a roll assembly employed to form the strip into the configuration illustrated in FIG. 8.

FIG. 28 illustrates the roll assembly 68 which forms part of the forming path 58 in its vicinity. Again, upper and lower rolls, generally designated 204 and 206, respectively, form the roll assembly 68. The roll assembly 68 utilizes as discs "1" and "2", profiled discs having the configuration described previously in connection with the description of the roll assembly 66. The remainder of the discs are cylindrical and have the dimensions illustrated in Tables 1 and 2. The discs "1" and "2" operate on the strip parts 100, 102, 112, 114 to place them in the configuration illustrated in FIG. 8. Disc No. 5, which is basically a cylindrical disc with both edges rounded, enters, but does not form the channel 122 (FIG. 7) between the strip parts 106, 108 for guidance purposes and to prevent the channel 122 from being deformed.

Figure 29:
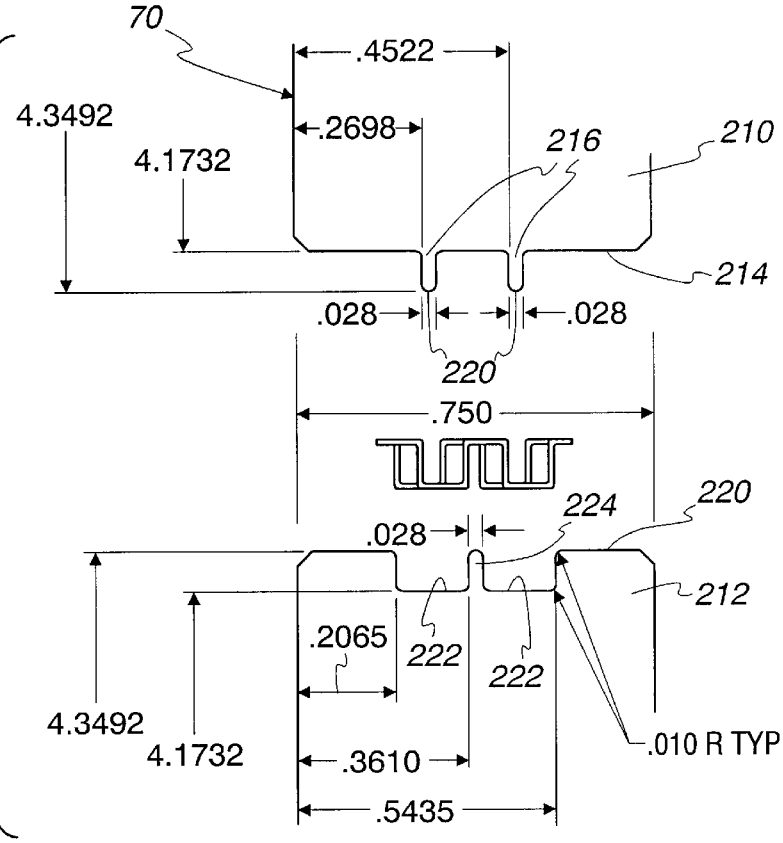
FIG. 29 is an enlarged, exploded, fragmentary sectional view of a roll assembly employed to size the fin strip after it has been formed to the configuration illustrated in FIG. 8.

The roll assembly 70, which is a sizing roll assembly, is illustrated in FIG. 29 and includes an upper roll 210 and a lower roll 212 which preferably are of solid configuration. The upper roll 210 has a basically cylindrical outer surface 214 which includes two spaced, annular, radially outwardly extending projections 216 whose radially outer surfaces 220 are basically cylindrical but provided with rounded corners. The lower roll 212 also includes a generally cylindrical outer surface 222 which is provided with two inwardly extending, peripheral grooves having bottom surfaces 222 separated by a radially outwardly extending, annular rib 224. The outer diameter of the rib 224 is the same as that of the cylindrical surface 220. In operation, the ribs 216 enter the spaces between the strip parts 102 and 104 and 110 and 112 while the projection 224 enters the gap 122 between the strip parts 106 and 108. In addition, the axially outer side walls of the grooves 222 engage the strip parts 100 and 114.

While actual forming is accomplished by the rolls 60–68, inclusive, the sizing roll assembly 70 illustrated in FIG. 29 is intended to assure that the finally formed fin is within the desired tolerances, that is, is intended to eliminate any imperfections that might result from the forming process as a result of stack-up of tolerances or minor misalignments of the various discs employed in the roll assemblies 62–68, inclusive. Where this is not a concern, the roll assembly 70 may be omitted.

The following Tables 1 and 2 supplement the dimensions illustrated in FIGS. 9–29 inclusive.

TABLE 1

(Profiled discs)

| Reference | | Outside Diameter (Inches) | Thickness (Inches) |
|---|---|---|---|
| Roll 1 | Discs 1, 2 | 4.3492 | 0.0800 |
| | Discs 3, 4 | 4.3030 | 0.0320 |
| Roll 2 | Discs 1, 2 | 4.3492 | 0.0450 |
| | Discs 3, 4 | 4.3292 | 0.0450 |
| Roll 4 | Discs 1, 2 | 4.3492 | 0.0450 |
| Roll 5 | Discs 1, 2 | 4.3492 | 0.0450 |

TABLE 2

(Cylindrical Discs)

| Reference | | Outside Diameter (Inches) | Thickness (Inches) |
|---|---|---|---|
| Roll 1 | Disc 5 | 4.2568 | 0.0400 |
| | Disc 6 | 4.2568 | 0.0210 |
| | Disc 7 | 4.3492 | 0.0230 |
| | Disc 14 | 3.5000 | 0.0280 |
| | Disc 17 | 4.2568 | 0.0340 |
| Roll 2 | Disc 5 | 4.1932 | 0.1870 |
| | Disc 6 | 4.3492 | 0.0280 |
| | Disc 7 | 4.1932 | 0.1500 |
| | Disc 10 | 4.1932 | 0.0420 |
| Roll 3 | Disc 5 | 4.1932 | 0.1430 |
| | Disc 6 | 4.1932 | 0.0410 |
| | Disc 7 | 4.3492 | 0.0280 |
| | Disc 10 | 4.3492 | 0.0280 |
| Roll 4 | Disc 3 | 4.1732 | 0.1920 |
| | Disc 4 | 4.1732 | 0.1450 |
| | Disc 5 | 4.3492 | 0.0280 |
| | Disc 6 | 4.1732 | 0.0620 |
| Roll 5 | Disc 3 | 4.1732 | 0.1200 |
| | Disc 4 | 4.3492 | 0.0380 |
| | Disc 5 | 4.3492 | 0.0280 |
| | Disc 6 | 4.1732 | 0.1840 |
| | Disc 7 | 4.1732 | 0.0500 |

It bears repeating that while the drawings and foregoing description deal with a four legged lanced and offset fin, fins having a greater number of legs may be provided simply by adding additional roll assemblies having profiled discs therein in the same general sequence described and illustrated in the drawings, keeping in mind, of course, that no more than two legs are to be formed in any given roll assembly.

It has been found that use of the invention results in the forming of lanced and offset fins at a production rate at least an order of magnitude greater than that which is obtainable on conventional stitching machines. Consequently, production times are greatly enhanced through use of the invention. Furthermore, there are no limitations on fin length as is the case with the use of stitching machines. The very nature of the operation is such that fins of indeterminate length may be made and then cut to the desired length which, in the case of the use of long, flattened tubes, may be significantly greater than the length of fins obtained through stitching machines. This simplifies the insertion of the fin into a tube and eliminates the possibility that there may be gaps between fins when two or more stitch formed fins are inserted into a given tube in order to provide fins along its entire length. This in turn assures the integrity of the tube against internal pressures by eliminating the potential for gaps between plural internal fins.

What is claimed is:

1. A method of making an elongated lanced and offset heat transfer fin of a desired length and having "n" legs, the method comprising the steps of:

a) advancing a continuous elongated, generally planar strip of indeterminate length of thin metal in its direction of elongation along a forming path;

b) in the forming path, i) firstly, forming n rows of spaced short slits in the strip, with the rows extending generally in the direction of elongation of the strip and the slits being generally transverse thereto;

ii) forming crowns in the parts of the strip between adjacent slits in each row with alternating parts in a row having crowns extending in one direction and the remaining parts having crowns extending in the opposite direction;

iii) preforming the two innermost legs by bending the parts of the two innermost rows at the opposed ends of the slits and the crowns of each row to partially form the legs;

iv) preforming the next two innermost legs by bending the parts of the next two innermost rows at the opposed ends of the slits and the crowns of each row;

v) repeating step iv) until the two outermost legs have been preformed;

vi) finally forming the two innermost legs to be generally transverse to the plane of the strip by further bending said parts of the two innermost rows at the opposed ends of the slits and the crowns of each of the two innermost rows;

vii) finally forming the next two innermost legs to be generally transverse to the plane of the strip by further bending said parts of the next two innermost rows at the opposed ends of the slits and the crowns of each of the next two innermost rows;

viii) repeating step vii) until said two outermost legs have been finally formed;

c) sizing the legs; and d) cutting the strip into fins of a desired length.

2. The method of claim 1 wherein steps b(i) and b(ii) are performed simultaneously.

3. The method of claim 1 wherein steps a), b) and c) are performed with rolls.

4. A method of making a lanced and offset fin for use in a heat exchanger, comprising the steps of:

a) advancing an elongated thin strip of generally planar form in its direction of elongation along a forming path;

b) in the forming path i) forming a plurality of rows of spaced short slits in the strip with the rows extending in the direction of elongation of the strip and with the slits being generally transverse to the direction of elongation of the strip;

ii) between adjacent slits in each row, alternatingly forming crowns which extend away from the plane of the strip in opposite directions, with adjacent crowns in adjacent rows also extending away from the plane of the strips in opposite direction, so that the parts of the strip extending between adjacent crowns in adjacent rows may be formed into legs; and iii) bending said parts in until said parts extend at a major acute angle to said plane of said strip while limiting the bending to the parts in no more than two of said rows at a given time.

5. The method of claim 4 wherein step b) is followed by the step of severing the strip into sections of a desired length.

6. The method of claim 4 wherein step b iii) is performed repetitively starting with the two innermost rows, followed by the next two innermost rows, in turn followed by the next two innermost rows, two rows at a time until the two outermost rows have been bent.

7. The method of claim 4 wherein step b) is performed using roll forming apparatus.

8. The method of claim 4 wherein step b ii) defines a preforming step wherein said parts are formed into legs extending away from said plane of strip at a minor acute angle.

9. The method of claim 4 wherein step b iii) is performed in at least two stages until said parts extend generally transverse to said plane of said strip.

10. The method of claim 4 wherein steps b i) and b ii) are performed simultaneously; wherein step b ii) defines a preforming step where said parts are formed into legs extending away from said plane of said strip at a minor acute angle; and wherein step b iii) is performed in two stages including a first stage wherein said parts are formed into legs extending away from said plane of said strip at a major acute angle and a second stage wherein said parts are formed into legs that are generally transverse to the plane of said strip.

11. A method of making a lanced and offset fin for use in a heat exchanger, comprising the steps of:

a) advancing an elongated thin strip of generally planar form in its direction of elongation along a forming path;

b) in the forming path i) forming a plurality of rows of spaced short slits in the strip with the rows extending in the direction of elongation of the strip with the slits being generally transverse to the direction of elongation of the strip;

ii) between adjacent slits in each row, alternatingly forming crowns which extend away from the plane of the strip in opposite directions, with adjacent crowns in adjacent rows also extending away from the plane of the strip in opposite direction, so that the parts of the strip extending between adjacent crowns in adjacent rows may be formed into legs; and iii) bending said parts in a plurality of at least two sequential stages until said parts define legs extending generally transverse to said plane of said strip.

12. The method of claim 11 wherein said strip is of indeterminate length and step b iii) is followed by the step d) of cutting said strip into sections of a desired length.

13. The method of claim 12 wherein step b iii) is followed by step d) and is preceded by the step of sizing the elongated lanced and offset fin resulting from step b iii).

14. The method of claim 11 wherein step b) is performed on roll forming apparatus.

15. A method of making an elongated lanced and offset heat transfer fin having "n" legs and comprising the steps of:

a) advancing an elongated, generally planar strip of fin forming material in its direction of elongation along a fin forming path;

b) forming "n" rows of transverse slits in the strip with crowns extending between adjacent slits in each row at locations intermediate the ends of the slits with adjacent crowns in each row being oppositely directed; and c) thereafter bending the strip through a substantial acute angle at each crown and at ends of adjacent slits in each of said rows with the ends at which the bending occurs alternating from one side of the row to the other for adjacent slits.

16. The method of claim 15 wherein the substantial acute angle is about 90°.

17. The method of claim 15 wherein step c) is performed in at least two sequential operations.

18. The method of claim 17 wherein a first of the operations includes said bending to an acute angle substantially less than said substantial acute angle and thereafter bending to said substantial acute angle.

19. The method of claim 17 wherein "n" is an even integer of four or more and one of said operations includes first bending at a first selected two of said rows and the other of said operations includes thereafter bending at a selected different two of said rows.

20. The method of claim 19 wherein the first selected two of said rows are the two centrally located rows.

21. The method of claim 19 wherein step c) is followed by the step of sizing the legs.

22. A method of making an elongated lanced and offset heat transfer fin having "n" legs and comprising the steps of:

a) advancing an elongated, generally planar strip of fin forming material in its direction of elongation along a fin forming path;

b) using a roll to form "n" rows of transverse slits in the strip with crowns extending between adjacent slits in each row at locations intermediate the ends of the slits with adjacent crowns in each row being oppositely directed; and c) using at least one roll to thereafter bend the strips through a substantial acute angle at each crown and at ends of adjacent slits in each of said rows with the ends at which the bending occurs alternating from one side of the row to the other for adjacent slits.

* * * * *